United States Patent [19]

Sugioka

[11] Patent Number: 4,991,783

[45] Date of Patent: Feb. 12, 1991

[54] YARN TRAVERSING METHOD AND AN APPARATUS THEREFOR

[75] Inventor: Takami Sugioka, Matsuyama, Japan

[73] Assignee: Teijin Seiki Co., Ltd., Osaka, Japan

[21] Appl. No.: 288,411

[22] Filed: Dec. 21, 1988

[30] Foreign Application Priority Data

Dec. 30, 1987 [JP] Japan ..... 62-336113
Feb. 23, 1988 [JP] Japan ..... 63-39807

[51] Int. Cl.[5] ..... B65H 54/28; B65H 54/32

[52] U.S. Cl. ..... 242/043 A; 242/018.1; 242/043.1

[58] Field of Search ..... 242/43 R, 43 A, 43.1, 242/158 R, 158 B, 18.1

[56] References Cited

U.S. PATENT DOCUMENTS

| | | | |
|---|---|---|---|
| 2,238,128 | 4/1941 | Nydegger | 242/158 B X |
| 3,333,782 | 8/1967 | Beckwith, Jr. | 242/158 B X |
| 3,362,652 | 1/1968 | Butterworth | 242/158 B X |
| 3,489,360 | 1/1970 | Torsellini et al. | 242/43 A |
| 3,650,486 | 3/1972 | Hasegawa et al. | 242/43 A |
| 3,659,796 | 5/1972 | Bucher et al. | 242/18.1 |
| 3,823,886 | 7/1974 | Siegenthaler | 242/43.1 |
| 3,964,724 | 6/1976 | Fisher et al. | 242/43 R |
| 4,165,047 | 8/1979 | Mackie | 242/43 A |
| 4,349,160 | 9/1982 | Niederer | 242/43 A X |
| 4,505,437 | 3/1985 | Schippers et al. | 242/43 A |
| 4,674,694 | 6/1987 | Hasegawa et al. | 242/43 R |
| 4,867,386 | 9/1989 | Schroff et al. | 242/43 A |

FOREIGN PATENT DOCUMENTS

| | | | |
|---|---|---|---|
| 3345237 | 6/1985 | Fed. Rep. of Germany | 242/43 A |

*Primary Examiner*—Stanley N. Gilreath
*Attorney, Agent, or Firm*—Burgess, Ryan & Wayne

[57] ABSTRACT

First and second traverse devices comprising rotary blades are overlapped, and the first traverse device conveys a yarn to a traverse end, and the second traverse device receives the yarn from one of rotary blades of the first traverse device and engages it with another rotary blade of the first traverse device.

7 Claims, 7 Drawing Sheets

YARN TRAVERSING METHOD AND AN APPARATUS THEREFOR

BACKGROUND OF THE INVENTION

This invention relates to a method for traversing a yarn in an apparatus for continuously winding the yarn to form a wound yarn package and an apparatus for effecting the same.

More specifically, the present invention relates to a yarn traversing method and a traversing apparatus for effecting the same, which apparatus comprises at least one pair of rotary blades which rotate in opposite directions and which apparatus transfer the yarn between the blades.

Conventionally known yarn traversing apparatuses of the above-described type are, for example, disclosed in Japanese Pat. Publication No. Sho 53-22178, Japanese Pat. Publication No. Sho 46-36258, and Japanese Pat. Laid-open No. Sho 59-194977.

However, in these conventionally known apparatuses, the yarn temporarily becomes in a free condition, i.e., the yarn becomes in an unstable condition, when a yarn is transferred from one of oppositely rotating yarn guides to the other yarn guide. Accordingly, there occurs a disadvantage that the obtained yarn quality is deteriorated because high shoulders are formed at ends of the package corresponding to traverse ends. Further, there occurs another disadvantage, which is sometimes referred to as "cob-webbing" and wherein a yarn wound on the shoulders is slipped down from the shoulders. Especially, when a yarn is wound at a high speed higher than 5,000 m/min, the yarn is fluctuated due to the moment of inertia when the traverse motion is reversed, and the above-described disadvantages are remarkable.

In order to obviate the above-described disadvantages, in Japanese Pat. Publication No. Sho 54-3985, it is proposed to dispose deflecting guides at certain positions inside the area encircled by lines connecting the traverse ends and a fulcrum of the traverse motion.

However, the deflecting guides serve the yarn only for very limited regions near the traverse ends. Accordingly, the fluctuation of the yarn is not fully prevented from occurring at the traverse ends due to the moment of inertia. As a result, there often occurs a so called cob-webbing wherein a yarn wound on the shoulders is slipped down from the shoulders, and further, winding of a yarn becomes impossible.

If it is desired to fully prevent such phenomena, the deflecting guides which are disposed above the traverse guide must be displaced toward the center of the traverse stroke. However, if this attempt is applied, the deflecting angle of the yarn at the deflecting guides increases, and the yarn is strongly rubbed against the deflecting guide. Accordingly, there is a disadvantage that the yarn quality is deteriorated since the tension in the yarn is enhanced.

SUMMARY OF THE INVENTION

It is an object of the present invention to provide a new method for traversing a yarn in an apparatus for continuously winding the yarn to form a wound yarn package, by which method the above-described disadvantages are obviated.

It is another object of the present invention to provide an apparatus for effecting the above-described method.

It is a further object of the present invention to provide a traversing method and a traversing apparatus, by which a yarn is surely traversed and wound in a package without forming high shoulders or cob-webbing.

According to the present invention, the above-described disadvantages are obviated and the above-described objects are achieved by a method for traversing a yarn along a bobbin, with which a contact roller contacts, by a traversing apparatus disposed at a position located downstream by a predetermined distance from a fulcrum for traverse motion, which method comprises:

conveying the yarn to a traverse end by traversing a substantially full traverse stroke by means of a first traverse means, which comprises at least a pair of rotary blades rotatable in opposite directions;

receiving the yarn conveyed by the first traverse means by means of a second traverse means which is disposed downstream by a predetermined distance from the first traverse means at positions near traverse ends and which comprises rotary blades:

then releasing the yarn from the rotary blade of the first traverse means: and engaging the released yarn with another rotary blade of the first traverse means which blade rotates opposite to the rotary blade of the first traverse means.

In addition, according to the present invention, the above-described disadvantages are obviated and the above-described objects are achieved by an apparatus for traversing a yarn along a bobbin, with which a contact roller contacts, the traversing apparatus comprises:

a first traverse means for traversing a substantially full traverse stroke disposed at a position located downstream by a predetermined distance from a fulcrum for traverse motion:

the first traverse means comprising at least a pair of rotary blades rotatable in opposite directions; and a second traverse means disposed downstream by a predetermined distance from the first traverse means at positions near traverse ends and which comprises rotary blades for receiving the yarn conveyed by the first traverse means and conveying the yarn to one of the traverse ends.

In preferred embodiments of the present invention, the first and second traverse means are so arranged that the yarn is moved by means of the rotary blade of the second traverse means to a position where the fulcrum, the rotary blade of the first traverse means, and a contacting point between the yarn conveyed by the rotary blade of the second traverse means and the contact roller align with a straight line or a line slightly deviated from the straight line toward the center of the traverse motion, and that thereafter the yarn is released from the rotary blade of the second traverse means.

BRIEF DESCRIPTION OF THE DRAWINGS

The present invention will now be explained in detail with reference to the accompanying drawings, wherein.

PREFERRED EMBODIMENTS

Figure 1:
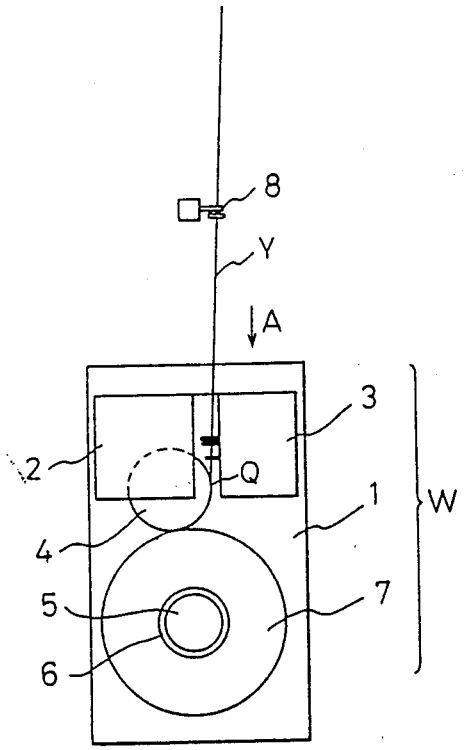
FIG. 1 is a schematic front view of a winding apparatus wherein a first embodiment of a traversing apparatus of the present invention is installed.
Figure 2:
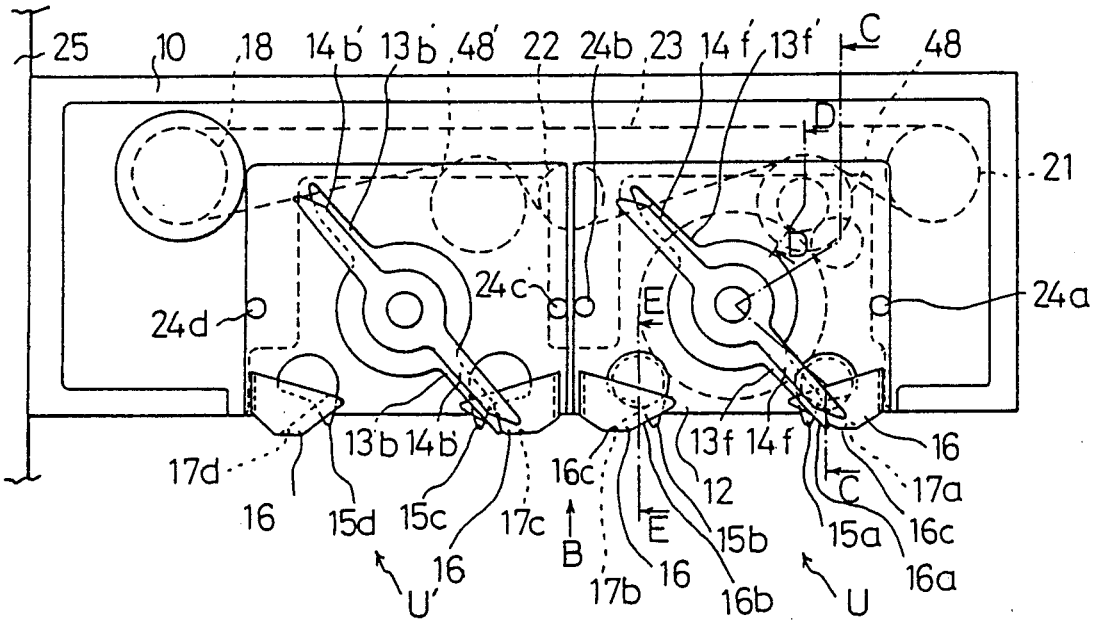
FIG. 2 is a plan view seen in direction of arrow A in FIG. 1 and showing the traversing apparatus of the present invention.
Figure 3:
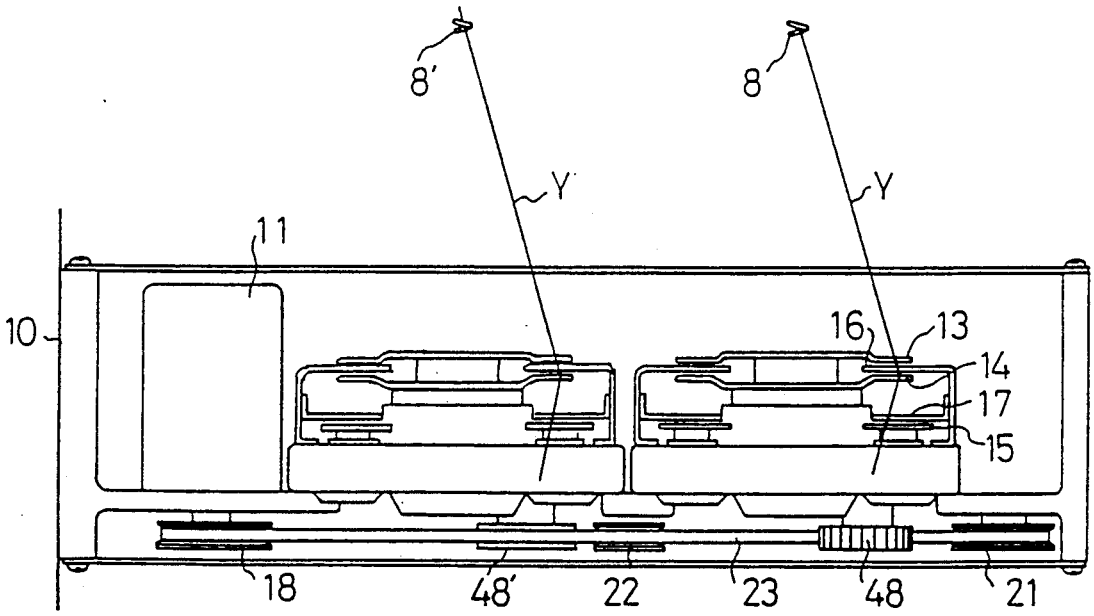
FIG. 3 is a side view seen in direction of arrow B in FIG. 2.
Figure 4:
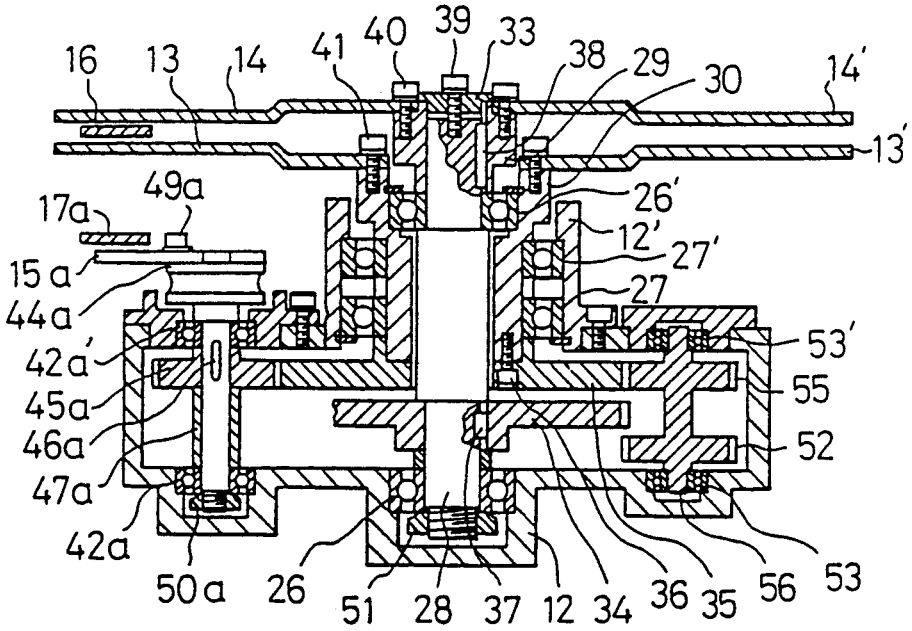
FIG. 4 is a cross sectional view taken along line C—C in FIG. 2.
Figure 5:
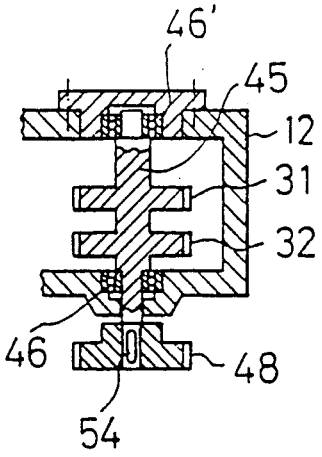
FIG. 5 is a cross sectional view taken along line D—D in FIG. 2.
Figure 6:
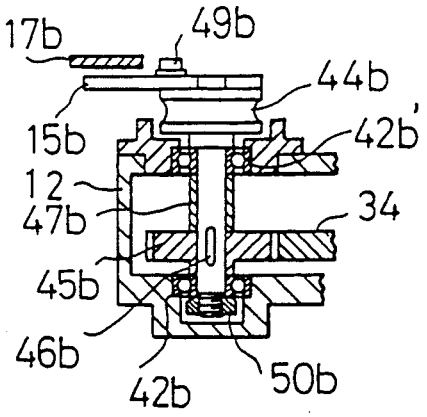
FIG. 6 is a cross sectional view taken along line E—E in FIG. 2.
Figure 7A:
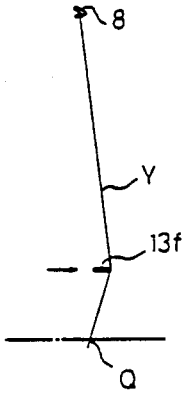
FIGS. 7(*a*) to 7(*f*) are front views sequentially showing the conditions wherein a yarn is transferred according to the present invention.
Figure 7B:
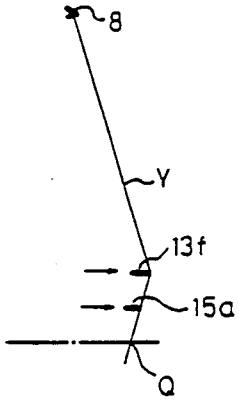
Figure 7C:
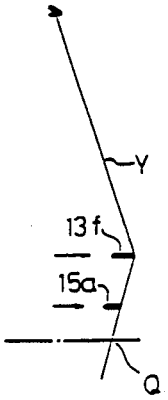
Figure 7D:
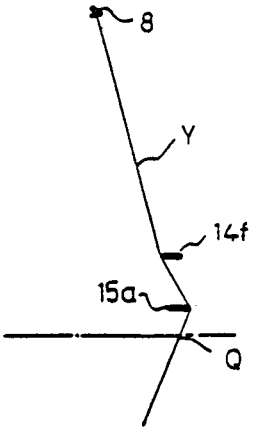
Figure 7E:
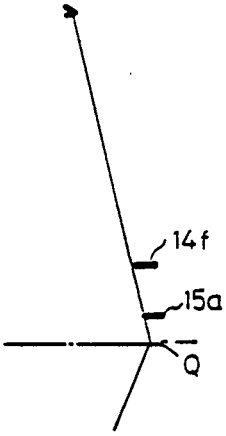
Figure 7F:
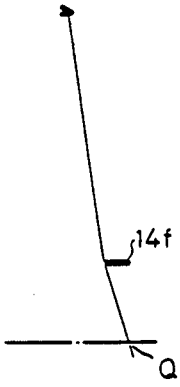
Figure 8A:
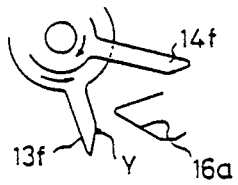
FIGS. 8(*a*) to 8(*f*) and 9(*a*) to 9(*f*) are plan views sequentially showing the conditions wherein a yarn is transferred according to the present invention.
Figure 8B:
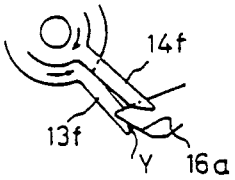
Figure 8C:
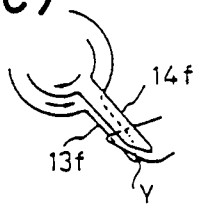
Figure 8D:
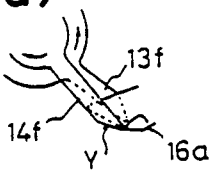
Figure 8E:
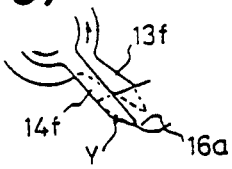
Figure 8F:
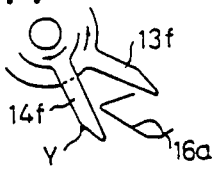
Figure 9A:
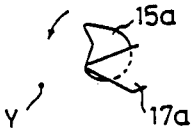
Figure 9B:
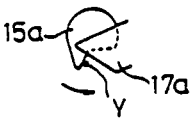
Figure 9C:
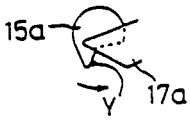
Figure 9D:
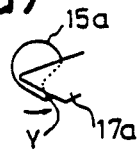
Figure 9E:
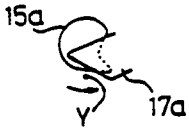
Figure 9F:
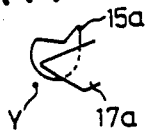

A first embodiment of the present invention will now be described with reference to the accompanying drawings, wherein FIG. 1 is a schematic front view of a winding apparatus provided with a traversing apparatus of the present invention, FIG. 2 is a plan view seen in direction of arrow A in FIG. 1 and showing the traversing apparatus of the present embodiment, FIG. 3 is a side view seen in direction of arrow B in FIG. 2, FIG. 4 is a cross sectional view taken along line C—C in FIG. 2, FIG. 5 is a cross sectional view taken along line D—D in FIG. 2, FIG. 6 is a cross sectional view taken along line E—E in FIG. 2, FIGS. 7 to 9 are front views and plan views sequentially showing the conditions wherein a yarn is transferred at the right traverse end, and FIG. 7(*a*), FIG. 8(*a*) and FIG. 9(*a*) illustrate conditions at the same instances, and so on.

In FIG. 1, after a yarn Y is drawn by a drawing apparatus (not illustrated), the yarn Y is fed through a snail guide 8, 8' (FIG. 14) which serves as a fulcrum of traverse motion, and is wound by a winding apparatus W.

The winding apparatus W comprises a traversing apparatus 3 for traversing the yarn Y to and fro, a contact roller 4 and a bobbin holder 5. The traversing apparatus 3 and the contact roller 4 are mounted on a slide block 2 which is vertically movable. The bobbin holder 5 is rotatably supported on a machine frame 1 and has two bobbins 6 inserted thereonto in the present embodiment. The contact roller 4 contacts the bobbins 6 inserted onto the bobbin holder 5.

Although the winding apparatus W of the present embodiment is a friction type winder wherein the contact roller frictionally drives the bobbin holder 5, the winding apparatus W may be a spindle drive type winder wherein a spindle of the bobbin holder is connected to a drive motor and is driven thereby.

The traversing apparatus 3 of the present embodiment is so disposed as to face the contact roller 4. However, a traversing apparatus may be disposed above a contact roller 4 in such a manner that a guide which traverses a yarn projects toward the yarn passage.

When a yarn Y is wound, the yarn Y is wound onto the contact roller 4 at a point Q while it is traversed by the traversing apparatus 3, and the yarn Y is wound onto the bobbin 6, which is inserted onto the bobbin holder 5 and which is driven by the contact roller 4, to form a yarn package 7.

The yarn Y is traversed to and fro by means of the traversing apparatus 3 illustrated in FIGS. 2 and 3.

The traversing apparatus 3 will now be explained in detail. A case 10 projects from a slide block 25 and has units U and U' detachably mounted thereon by bolts 24*a*, 24*b*, 24*c* and 24*d*.

The construction of the units U and U' will now be explained referring to FIG. 4. A hollow spindle 30 is rotatably supported by cases 12 and 12' via a pair of bearings 27 and 27'. The upper portion of the hollow spindle 30 has blades 13 and 13' secured thereto by bolts 41. The blades 13 and 13' in different sets have letters a, b, and so on appended to the numerals. The blades 13 and 13' are formed in a lever shape and traverse the yarn Y. A spindle 28 is disposed in the hollow portion of the hollow spindle 30 in such a manner that it is co-axial with the hollow spindle 30 and its upper end exceeds the upper end of the hollow spindle 30. The spindle 28 is rotatably supported by the case 12 and the hollow spindle 30 via bearings 26 and 26'.

A boss 29 is fixed to the upper portion of the spindle 28 by a key 38, and blades 14 and 14' are secured to the boss 29 by bolts 40. The blades 14 and 14' in different sets have letters a, b and so on appended to the numerals. The blades 14 and 14' are also formed in a lever shape and traverse the yarn Y. A stop plate 33 is secured to the upper end of the spindle 28 by a bolt 39 so as to axially fasten the boss 29 and the bearings 26 and 26'.

The blades 13, 13', 14 and 14' have yarn guides, respectively, and the blades 14 and 14' are located above the blades 13 and 13'. The lower end of the hollow spindle 30 has a gear 35 secured thereto by a bolt 36. Further, the spindle 28 has a gear 34 fixed thereto by a key 37. The gear 34 and the bearing 26 are axially secured by a nut 51 threaded with a screw formed at the lower end of the spindle 28.

At the turning point of the traverse motion, i.e., the position where the blade 13 or 13' meets with the blade 14 or 14', a guide 16 is fixed to the case 12 as illustrated in FIG. 2 so that it locates between the blades 13 and 14 as illustrated in FIG. 4. The guide 16 serves to release the yarn Y, which has been conveyed by the blade 13 or 14, from the blade 13 or 14.

The surfaces 16*a* and 16*b* of the guide 16 are inclined outwardly from the traversing region so that the yarn Y is released from the blade 13 or 14 when it is pushed onto the inclined surfaces 16*a* or 16*b* by the blade 13 or 14. The portion 16*c* of the guide 16 is connected to the inclined surface 16*a* and 16*b* and prevents the yarn Y from fluctuating in the horizontal direction in FIG. 1 while the yarn Y is traversed. The portion 16*c* also serves to limit the amount of radius of gyration of the yarn Y which is conveyed by the blade 13 or 14. The blades 13 and 14 and the guide 16 constitute a first traverse means.

In the present embodiment, the separate guides 16 are individually disposed at positions corresponding to the traverse ends. However, both the guides may be connected in one body, and the connecting portion may be curved so as to adjust the traversing speed of the yarn Y which is conveyed by the blades 13 and 14.

As illustrated in FIG. 2, at the yarn turning points of the first traverse means, blades 15*a* and 15*b* are disposed downstream of the first traverse means so that they receive the yarn Y, which has been conveyed by the blades 13 and 14, and move it to the corresponding traversing ends. Numeral 15*d* is used in the drawings to refer to a blade corresponding to one of the blades 15*a* and 15*b*. As illustrated in FIGS. 2 and 9, the blades 15*a* and 15*b* are formed in a circular disk provided with a triangular projection. The blades 15*a* and 15*b* are fixed to spindles 44*a* and 44*b* by bolts 49*a* and 49*b* as illustrated in FIGS. 4 and 6. The spindle 44*a* locates at the right traversing end and the spindle 44*b* locates at the left traversing end. The spindles 44*a* and 44*b* are rotatably supported on the case 12 by bearings 42*a*, 42*a*', 42*b* and 42*b*'.

As illustrated in FIG. 4, a gear 45*a* is fixed to the spindle 44*a* at the upper central portion thereof by a key 46*a* and meshes with the gear 35 so as to be driven thereby. Similarly, as illustrated in FIG. 6, a gear 45*b* is fixed to the spindle 44*b* at the lower central portion thereof by a key 46*b* and meshes with the gear 34 so as to be driven thereby. As illustrated in FIG. 4, the bearing 42*a*, the gear 45*a*, a distance piece 47*a* and the bearing 42*a*' are inserted onto the spindle 44*a* and are secured by a nut 50*a*. Similarly, as illustrated in FIG. 6, the bearing 42*b*, the gear 45*b*, a distance piece 47*b* and the bearing 42*b*' are inserted onto the spindle 44*b* and are secured by a nut 50*b*.

As illustrated in FIGS. 2 and 4, the guide 16 is provided with guides 17*a* and 17*b* for releasing the yarn Y, which has been conveyed to the traverse turning portion by the blade 15*a* or 15*b*, from the blade 15*a* or 15*b*. Numeral 17*c* or 17*d* is used in the drawings to refer to a blade corresponding to one of guides 17*a* and 17*b*, and numeral 17 is used in the drawings to generally designate a guide 17*a* or 17*b*.

The guides 17*a* and 17*b* are provided with inclined surfaces 17*a* and 17*b* like the guide 16, which inclined surfaces are inclined outwardly from the traversing region so that the yarn is released from the blade 15*a* or 15*b* when it is pushed onto the inclined surfaces 17*a* or 17*b* by the blade 15*a* or 15*b*. The blades 15*a* and 15*b* and the guides 17*a* and 17*b* constitute a second traverse means.

Gears 52 and 55 are integrally formed with a spindle 56 which is rotatably supported on the case 12 at the right portion in FIG. 4 via bearings 53 and 53'. The gear 55 meshes with the gear 35, and the other gear 52 meshes with the gear 32 which is illustrated in FIG. 5. The gear 32 is formed integral with a spindle 45 together with a gear 31, and the spindle 45 is rotatably supported on the case 12 via bearings 46 and 46'.

The gear 31 illustrated in FIG. 5 meshes with the gear 34 illustrated in FIG. 4.

The lower end of the spindle 45 has a pulley 48 fixed thereto by a key 54, and the rotation of the pulley 48 is transmitted to the gears 34 and 35 through the spindle 45 and gears 31, 32, 52 and 55. More specifically, because of engagement of the gears, the spindle 28 illustrated in FIG. 4 and the spindle 44*b* illustrated in FIG. 6 are rotated in clockwise direction in FIG. 2, and the hollow spindle 30 illustrated in FIG. 4 and the spindle 44*b* are rotated in a counter-clockwise direction in FIG. 2.

As illustrated in FIG. 3, the case 10 has a motor 11 mounted thereon. The output spindle of the motor 11 has a pulley 18 fixed thereto, and pulleys 21 and 22 (see FIGS. 2 and 3) are mounted on spindles rotatably projecting from the case 10. An endless timing belt 23 is wrapped around the pulleys 18, 21 and 22 and is also engaged with the pulleys 48 and 48' disposed in the units U and U' so as to drive the units U and U'.

The above-explained first and second traverse means have their phases and timings adjusted so that they can perform the yarn transferring steps which will be described below. The yarn transferring steps will now be explained with regard to the turning portion illustrated in the right in FIG. 2.

As denoted by an arrow in FIG. 7(*a*), a blade 13*f* conveys a yarn Y from the left to the right. When the yarn Y nears the traversing end, the blade 15*a*, which is disposed below the blade 13*f*, receives the yarn Y extending between the blade 13*f* and the outer periphery of the contact roller 4. At the moment, the blade 15*a* receives the yarn Y which has been conveyed by the blade 13*f* without disturbing the movement of the yarn Y, and the yarn Y is displaced to the right by both the blades 13*f* and 15*a* as illustrated in FIGS. 8(*b*) and 9(*b*).

When the yarn Y is moved to the traversing end, the yarn Y is pushed onto the inclined surface 16*a* of the guide 16 as shown in FIG. 8(*c*) and is released from the blade 13*f* as shown in FIG. 8(*d*), and then the yarn is conveyed only by the blade 15*a* as shown in FIG. 9(*d*).

At a position between the snail guide 8, which serves as a fulcrum of the traverse motion, and the blade 15*a*, the yarn Y, which is conveyed by the blade 15*a*, engages with the blade 14*f*, which is rotating in a direction opposite to that of the blade 13*f*. However, the yarn Y is continued to be conveyed by the blade 15*a* toward the traverse end. When the yarn Y reaches at such a position that the snail guide 8 for fulcrum of the traverse motion, the blade 14*f* and the contacting point Q where the yarn Y conveyed by the blade 15*a* contacts with the contact roller 4 align with a straight line as illustrated in FIG. 7(*e*) or a line slightly deviated from the straight line toward the center of the traverse motion, the yarn Y, which has been conveyed by the blade 15*a*, engages with the guide 17*a*, is pushed onto the inclined surface thereof and is released from the blade 15*a*.

It is preferred that the angle formed between the above-described straight line and the axis of the contact roller 4 is set about a winding angle.

When the yarn Y is traversed as described above, it is always in a tight condition at the traverse turning portion, and accordingly, the yarn Y is not loosened when it is disengaged from the blade 15*a*. Thus, formation of cob-webbing can be prevented.

Further, when the yarn is disengaged from the blade 15*a*, the yarn Y is pulled by the blade 14*f* toward the center of the traverse motion as illustrated in FIG. 7(*f*), the yarn Y can be sharply turned. Accordingly, high shoulders around the ends of a yarn package can be prevented from occurring.

Another embodiment will now be explained with reference to FIGS. 10 to 12.

In this embodiment, in addition to the above-described traversing apparatus of the first embodiment, such an additional means is provided that during formation of a package by traversing the yarn at a predetermined traverse stroke in an axial direction of the bobbin by the first and second traverse means, the second traverse means is continuously or discontinuously made not to serve the yarn for several strokes or to alter degree of service for several strokes so that the yarn is traversed at a shorter traverse stroke. Accordingly, the same parts as those in the first embodiment are designated by the same reference numerals, and further explanation of the construction similar to that of the above-described first embodiment is omitted here.

Figure 10:
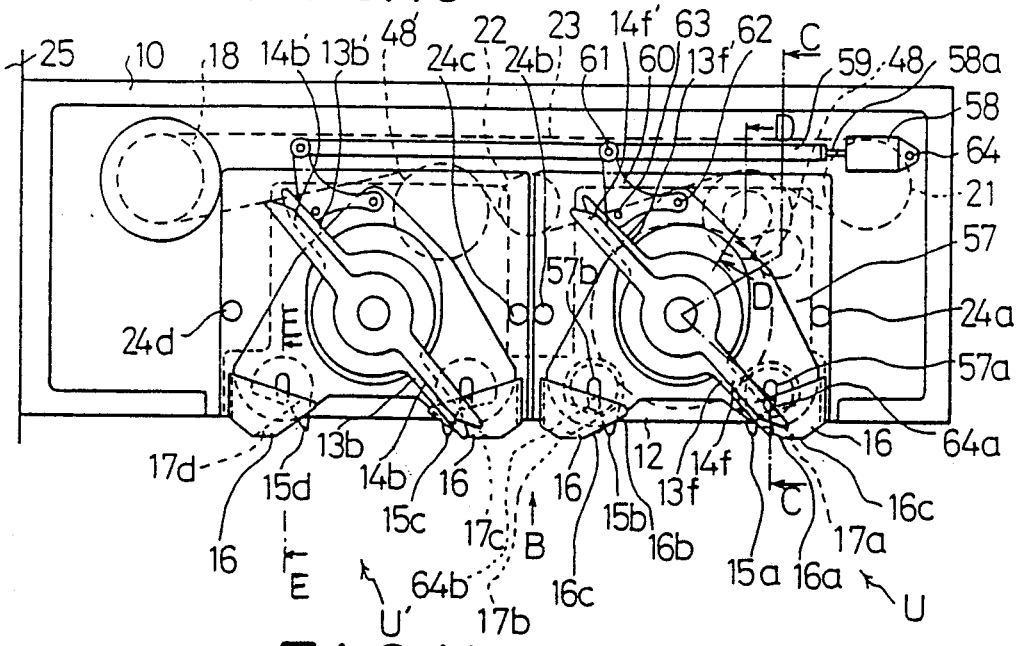
FIG. 10 is a schematic front view of another embodiment of a traversing apparatus according to the present invention.
Figure 11:
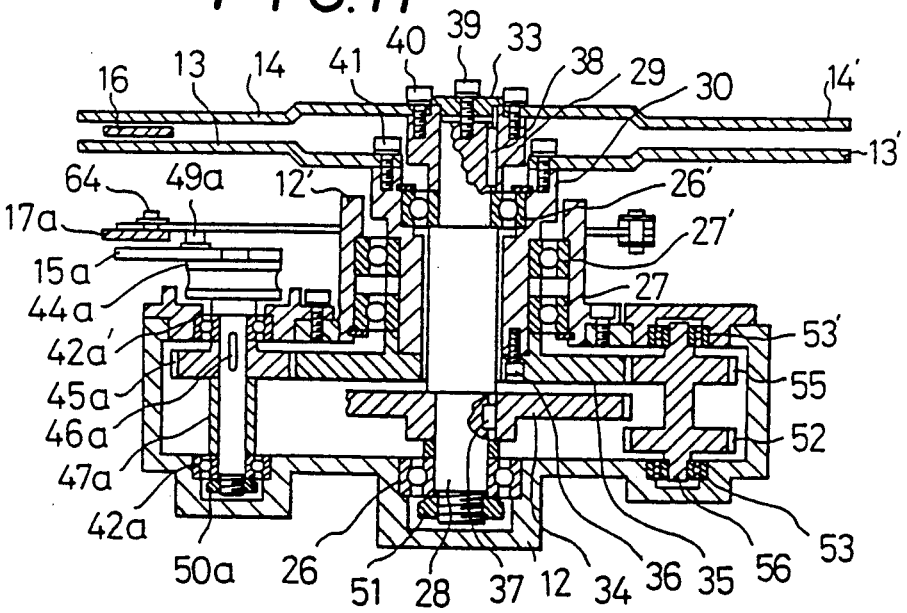
FIG. 11 is an enlarged cross sectional view of an essential part of FIG. 10 and taken along line C—C.
Figure 12A:
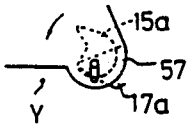
FIGS. 12(*a*) to 12(*d*) are plan views sequentially showing the conditions wherein a yarn is transferred according to the present invention.
Figure 12B:
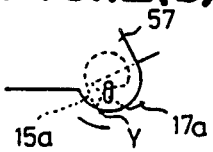
Figure 12C:
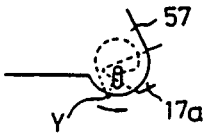
Figure 12D:
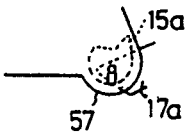

As illustrated in FIG. 10, in this embodiment, a guide 57 is diagrammatically formed in a triangular shape and is disposed normal to the yarn passage above the second traversing apparatus. The guide 57 is movable between a position where the guide 57 covers a yarn engaging point of the second traverse means as seen along a yarn passage and a position where the guide 57 does not cover the yarn engaging point of second traverse means.

More specifically, referring to FIG. 10, elongated guide holes 57*a* and 57*b* formed near the lower apexes of the guide 57 engage with pins 64*a* and 64*b*, respectively, which project from the guides 17*a* and 17*b*, respectively. Further, a pin 62 projects at the upper apex of the guide 57. The case 12 has a pin 63, which swingably supports an L-shaped lever 60. An end of the L-shaped lever 60 engages with the pin 62, and the other end of the L-shaped lever 63 is connected to a bar 59 via a pin 61. The case 12 has a fluid pressure cylinder 58 swingably mounted thereon via a pin 64, and a rod 58*a* of the fluid pressure cylinder 58 is connected to the bar 59.

An appropriate program has been previously programmed in a microcomputer (not shown). During the winding operation, the fluid pressure cylinder 58 is actuated in accordance with the previously memorized program via an electro-magnetic valve (not shown) at a predetermined time interval for a predetermined duration, and the guide 57 covers the yarn engaging portion of the second traverse means so that the second traverse means does not serve the yarn Y.

The above-explained first and second traverse means and the guide are adjusted their phases and timings so that they can perform the following yarn transferring steps. The yarn transferring steps will now be explained with regard to the turning portion illustrated in the right in FIG. 10.

First, the guide 57 is move backwardly, i.e, upwardly in FIG. 10, so that the second traverse means can be seen below the guide when it is seen along a yarn passage as illustrated in FIG. 12. Accordingly, the guide 57 substantially does not serve the yarn Y. Thus, the yarn Y is traversed in a manner similar to that explained with reference to FIGS. 7 to 9.

When the guide 57 is moved forwardly, i.e., downwardly in FIG. 10, the yarn engaging portion of the second traverse means is covered by the guide 57 if it is seen along a yarn passage, i.e., in a condition illustrated in FIG. 12, the second traverse means does not serve the yarn Y. As a result, the yarn Y is wound while it is traversed at a traverse stroke shorter than a predetermined normal traverse stroke. The steps of this instance will now be described with reference to the above-described FIGS. 7 and 8 and FIG. 12.

In FIGS. 7(*a*), 8(*a*) and 12(*a*), the guide 57 is pushed toward the passage of the running yarn Y and it covers the blade 15 so that the blade 15 does not serve the yarn Y, and the yarn Y is conveyed from the left to the right by the blade 13*f*.

As illustrated in FIGS. 7(*b*), 8(*b*) and 12(*b*), the yarn Y is moved to the right by the blade 13*f* and the yarn Y nears the traverse end. However, the blade 15*a* is covered by the guide 57 and does not serve the yarn Y, and accordingly, the yarn Y is conveyed by only the blade 13*f*.

In FIGS. 7(*c*), 8(*c*) and 12(*c*), the yarn Y conveyed by the blade 13*f* is released from the blade 13*f* by means of the inclined surface 16*a* of the guide 16. In that moment, the yarn Y is not engaged with the blade 15*a*. Accordingly, the yarn Y is not conveyed to the traverse end which is common when the guide 57 is moved backwardly. Since the yarn Y is wound onto a package at a winding angle "alpha", the yarn Y released from the blade 13*f* is delayed a small distance "delta S" toward the center of the traverse motion, wherein "delta S"=(distance between the blade 13*f* and the point Q where the yarn Y contacts with the contact roller 4) multiplied by tangent "alpha". The yarn Y is returned keeping the small delay "delta S". Accordingly, the width of the package wound under this condition is shorter than that wound under the normal condition by a distance of twice as large as "delta S".

Then, the yarn is released from the blade 13*f* as illustrated in FIGS. 8(*d*) and 12(*d*), it is engaged with the blade 14*f* which rotates in a direction opposite to that of the blade 13*f* and is moved to the left.

During formation of a package with traversing the yarn at a predetermined traverse stroke by means of the first and second traverse means wherein the guide 57 is moved backwardly (FIG. 9), the winding operation only by the first traverse means is continuously or discontinuously repeated for several strokes. Thus, a good yarn package which is free from high shoulders or cobwebbing can be obtained.

Figure 18:
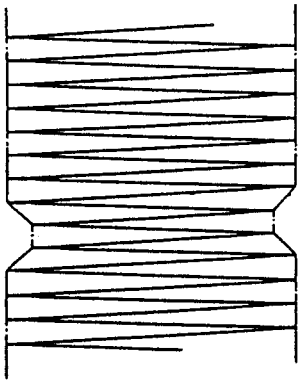
FIGS. 18 and 19 are traverse stroke diagrams according to embodiments of the present invention.

For example, traverse motion can be controlled in accordance with a traverse stroke diagram illustrated in FIG. 18. In this example, the traverse stroke is shortened by between 5 and 15 mm for between one tenth and one thirtieth of the normal traverse strokes.

Although the guide 57 is disposed upstream of the second traverse means in this embodiment, it may be disposed at a position between the second traverse means and the contact roller 4.

In this embodiment, the guide 57 is used so that the second means does not serve the yarn. A still further embodiment will now be explained.

Figure 13:
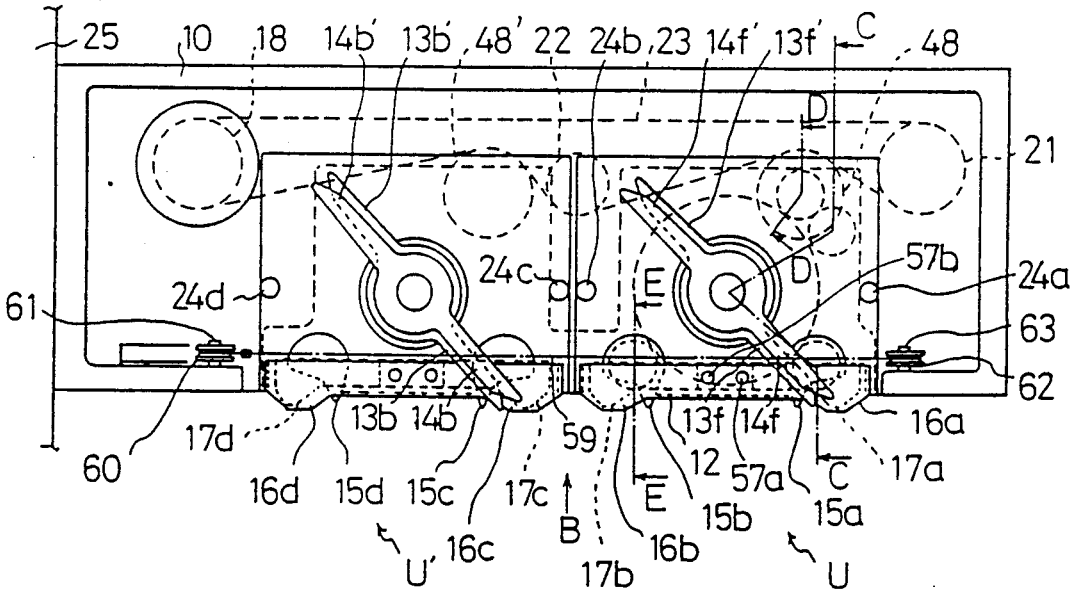
FIG. 13 is a plan view of another embodiment.
Figure 14:
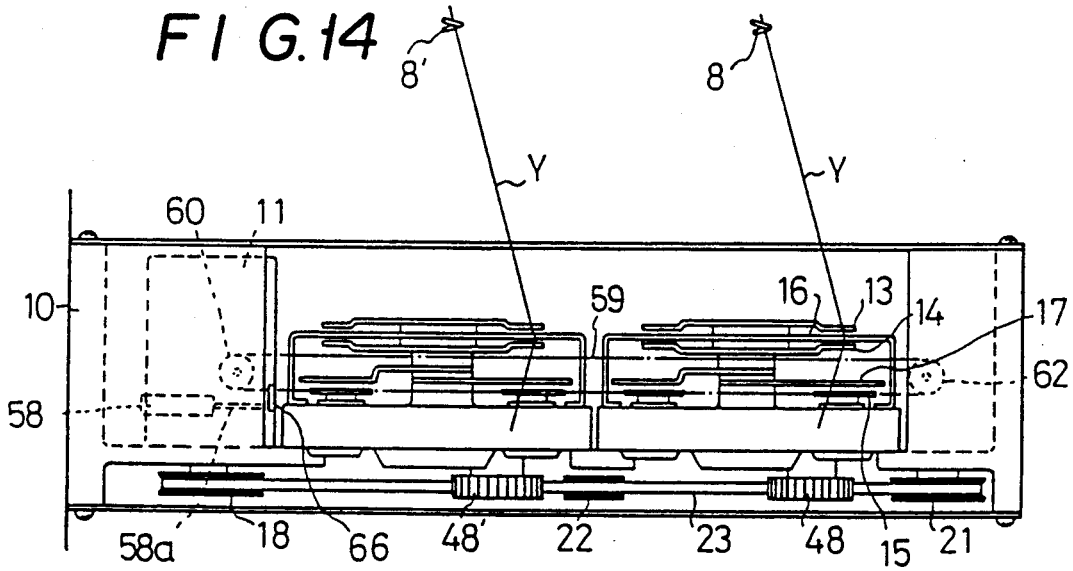
FIG. 14 is a front view of the embodiment of FIG. 13.
Figure 15A:
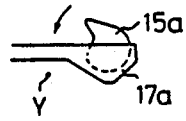
FIGS. 15(*a*) to 15(*d*) are plan views sequentially showing the conditions wherein a yarn is transferred in the apparatus illustrated in FIG. 13.
Figure 15B:
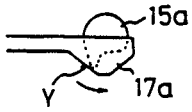
Figure 15C:
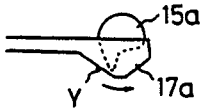
Figure 15D:
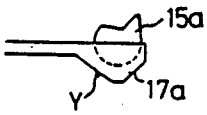
Figure 16:
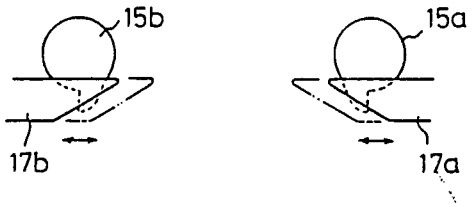
FIG. 16 is a plan view showing the principle of the embodiment shown in FIG. 13.

In the embodiment illustrated in FIGS. 13 and 14, the guides 17*a* and 17*b* are moved toward the center of the traverse motion (see FIG. 16) so that the amount for which the second traverse means serve the yarn Y is varied or so that the second traverse means is made not to serve the yarn Y at all. Parts similar to those in the above-described embodiments are designated by the same reference numerals and their further explanation is omitted here.

The guides 17*a* and 17*b* are slidably mounted on the case 12 by means of pins 57*a* and 57*b*. The case 10 has pulleys 60 and 62 rotatably mounted thereon. The guides 17*a* and 17*b* are connected to a wire 59 wrapped around the pulleys 60 and 62. The wire 59 is further connected to a rod 58*a* of a fluid pressure cylinder 58 by means of a joint 66.

An appropriate program is previously programmed in a microcomputer (not shown). During the winding operation, the fluid pressure cylinder 58 is actuated in accordance with the previously memorized program via an electro-magnetic valve (not shown) at a predetermined time interval for a predetermined duration, the degree of service of the second traverse means to the yarn Y is varied. The guides 17*a* and 17*b* may be disposed downstream of the blades 15*a* and 15*b*.

In this embodiment, a fluid pressure cylinder is used to move the guides 17*a* and 17*b*, nevertheless, any other appropriate means, such as a stepping motor or a servo motor may be used in place of the fluid pressure cylinder.

When the guides 17*a* and 17*b* do not cover the second traverse means, the yarn Y is traversed at a predetermined traverse stroke in a manner similar to that explained with reference to FIGS. 7 to 9.

When the guides 17*a* and 17*b* are moved toward the center of the traverse motion, the yarn Y is conveyed by the blade 13*f* to the right as illustrated in FIGS. 7(*b*), 8(*b*) and 15(*b*). When the yarn nears the right traverse end, the yarn is conveyed by only the blade 17*a* since the blade 15*a* is covered by the guide 17*a*.

In FIGS. 7(*c*), 8(*c*) and 15(*c*), the yarn Y conveyed by the blade 13*f* is released from the blade 13*f* by means of the guide 17*a*, and accordingly, the traverse stroke is shorter than that of the normal condition.

Figure 19:
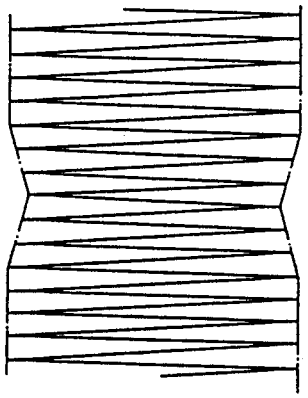

Thus, such a traverse control as illustrated in FIG. 19 can be done.

Figure 17:
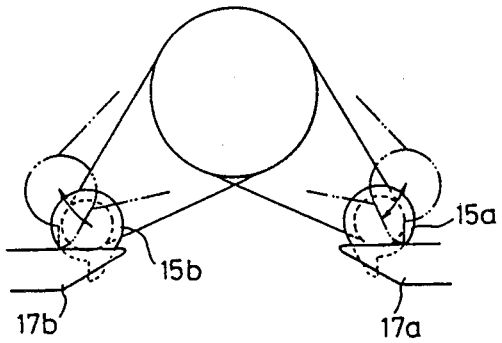
FIG. 17 is a plan view of a still further embodiment.

In an embodiment illustrated in FIG. 17, the second traverse means, i.e., the guides 15*a* and 15*b*, are disposed on a swingable arm so that they can be receded from the yarn passage.

The above-explanations have been done with respect to the transfer of a yarn at the right side of the traverse stroke, and a similar yarn transfer is also done at the left side.

Further, although traversing apparatuses are exemplified in the above-described embodiments, wherein two bobbins are inserted onto a bobbin holder so as to simultaneously wind two packages, one package or more than two packages may be wound at the same time.

In addition, a manual winder provided with single bobbin holder spindle is exemplified in the above-described embodiments, however, the present invention is also applicable to an automatic winder which is provided with a plurality of bobbin holder spindles.

Besides, though straightly inclined guides are used as a guide for releasing a yarn from rotary blade 15, the guide surface may be a curve of an appropriate configuration so that the speed of the yarn Y conveyed by the blade is adjusted. Furthermore, the second traverse means serves a yarn only near the traverse ends in the above-described embodiments, the second traverse means may serve the yarn in the whole traverse region.

In an embodiment, the centers of rotation of the rotary blades rotatable in opposite directions may be deviated in place of stationary inclined guides in the above-described embodiments so that the yarn can be released from the rotary blades of the first traverse means.

Although the yarn Y is released from the rotary blade 15 by means of a stationary inclined guide 17*a* after the yarn Y is received by the rotary blade of the second traverse means in the above described embodiments, a rotary blade (not shown) rotatable in a direction opposite to the rotary blade 15*a* may be disposed so as to release the yarn from the rotary blade 15.

As described above, the traversing apparatus of the present invention comprises: a first traverse means for traversing a substantially full traverse stroke disposed at a position located downstream by a predetermined distance from a fulcrum for traverse motion: the first traverse means comprising at least a pair of rotary blades rotatable in opposite directions: and a second traverse means disposed downstream by a predetermined distance from the first traverse means at positions near traverse ends and which comprises rotary blades for receiving the yarn conveyed by the first traverse means and conveying the yarn to one of the traverse ends. Accordingly, a yarn is surely traversed and wound in a package without forming high shoulders or cob-webbing.

Especially, it is preferred that the first and second traverse means are so arranged that the yarn is moved by means of the rotary blade of the second traverse means to a position where the fulcrum, the rotary blade of the first traverse means, and a contacting point between the yarn conveyed by the rotary blade of the second traverse means and the contact roller align with a straight line or a line slightly deviated from the straight line toward the center of the traverse motion, and that thereafter the yarn is released from the rotary blade of the second traverse means. The yarn is always kept in a tight condition according to this arrangement, and the advantages of the present invention is further enhanced. Especially, when a yarn is wound at a high speed higher than 5,000 m/min, wherein the yarn is usually fluctuated due to the moment of inertia when the traverse motion is reversed, the above-described arrangement is useful to achieve the above-described advantages of the present invention.

What is claimed is:

1. A method for traversing a yarn along a bobbin, with which a contact roller contacts, by a traversing apparatus disposed after the fulcrum for traverse motion and separated by a predetermined distance therefrom, which method comprises the steps of:

conveying said yarn to a traverse end by traversing said yarn through a substantially full traverse stroke by means of a first traverse means, which comprises a least one first plate guide and at least a pair of rotary blades rotatable in opposite directions and cooperating with said first plate guide;

receiving said yarn conveyed by one of said rotary blades of said first traverse means by means of a rotary blade of a second traverse means which is disposed after said first traverse means and separated by a predetermined distance therefrom at positions near traverse ends and which comprises at lease one second plate guide and rotary blades cooperating with said second plate guide;

then releasing said yarn from said one of said rotary blades of said first traverse means by means of cooperation of said first plate guide and said one of said rotary blades;

engaging said released yarn with another rotary blade of said first traverse means which blade rotates opposite to said one of said rotary blades of said first traverse means;

comprising moving said yarn by means of said rotary blade of said second traverse means to a position wherein said fulcrum, said rotary blades of said first traverse means, and a contacting point between said yarn conveyed by said rotary blade of said second traverse means and said contact roller at least align with an imaginary line that at least approximates a straight line; and then releasing said yarn from said rotary blade of said second traverse means by means of cooperation of said second plate guide and said rotary blade of said second traverse means.

2. A method according to claim 1 further comprising traversing the yarn at a shorter traverse stroke by disengaging the yarn from the second traverse means or altering the contact of the yarn by the second traverse means during formation of a package by traversing said yarn at a predetermined traverse stroke in an axial direction of said bobbin by said first and second traverse means, for several strokes.

3. A method according to claim 2, wherein said traverse means disengages said yarn so that said yarn is traversed at said shorter traverse stroke.

4. An apparatus for traversing a yarn along a bobbin, with which a contact roller contacts, said traversing apparatus comprises:

a first traverse means for traversing said yarn through a substantially full traverse stoke disposed after a fulcrum for traverse motion and separated by a predetermined distance therefrom;

said first traverse means comprising at least one first plate guide and at least a pair of rotary blades rotatable in opposite directions, said first plate guide and said pair of rotary blades cooperating with each other to receive and release said yarn;

a second traverse means disposed after said first traverse means and separated by a predetermined distance therefrom at positions near traverse ends of the first traverse means; and said second traverse means comprising at least one second plate guide and rotary blades for cooperating with said second plate guide to receive said yarn conveyed by one of said blades of said first traverse means and to convey said yarn to one of said traverse ends of the first traverse means; and means for moving said yarn by said rotary blade of said second traverse means to a position where said fulcrum, said rotary blades of said first traverse means, and a contacting point between said yarn conveyed by said rotary blade of said second traverse means and said contact roller at least align with an imaginary line that at least approximates a straight line, and that thereafter said yarn is released from said rotary blade of said second transverse means.

5. An apparatus according to claim 4, which further comprises a guide which is movable between a position where said guide covers portions on said second traverse means which portions engage with said yarn as seen in a direction from said fulcrum of traverse motion to said bobbin and a position where said guide does not cover said portions of said second transverse means.

6. An apparatus according to claim 4 wherein said plate guide of said second traverse means is movable relative to said rotary blade of said second traverse means.

7. An apparatus according to claim 4, wherein said plate guide of said second traverse means is stationary, and a position of a center of rotation of said rotary blade of said second traverse means is movably disposed relative to said stationary guide.

* * * * *